United States Patent [19]

Tanaka et al.

[11] 4,157,111

[45] Jun. 5, 1979

[54] METHOD OF HEAT-TREATING DUCTILE CAST IRON PIPE

[75] Inventors: Yoshio Tanaka, Takarazuka; Susumu Togawa, Nishinomiya; Akinori Sakoda, Amagasaki, all of Japan

[73] Assignee: Kubota, Ltd., Japan

[21] Appl. No.: 872,582

[22] Filed: Jan. 26, 1978

Related U.S. Application Data

[63] Continuation of Ser. No. 678,899, Apr. 21, 1976, abandoned.

[30] Foreign Application Priority Data

Jan. 6, 1976 [JP] Japan ..... 51-1298

[51] Int. Cl.[2] ..... B22D 13/02; B22D 33/00; C21D 9/08; C21D 5/00

[52] U.S. Cl. ..... 164/76; 164/270; 164/286; 164/298; 266/257

[58] Field of Search ..... 164/76, 118, 122, 123, 164/124, 126, 128, 270, 286, 297, 298, 338; 266/121, 123, 156, 251, 252; 148/3, 35, 138; 266/257

[56] References Cited

U.S. PATENT DOCUMENTS

| | | | |
|---|---|---|---|
| 119,682 | 10/1871 | Yielding | 164/122 |
| 1,546,532 | 7/1925 | Baily | 266/156 X |
| 2,079,334 | 5/1937 | Parsons | 266/251 X |
| 2,996,293 | 8/1961 | Fallon | 266/252 |

*Primary Examiner*—Othell M. Simpson
*Assistant Examiner*—Gus T. Hampilos
*Attorney, Agent, or Firm*—Wenderoth, Lind & Ponack

[57] ABSTRACT

A method of heat-treating and, particularly, annealing, a ductile cast iron pipe in the form as centrifugally held against the wall of a centrifugal casting mold. The casting within the mold is heat-treated by introducing a hot gas of elevated temperature into the hollow of the casting. At the initial stage, the casting within the mold is in red-hot condition and, therefore, introduction of the hot gas into the hollow of the casting results in control of the dissipitation of heat energies from the red-hot casting to delay or slow down a cooling rate of the casting.

9 Claims, 3 Drawing Figures

METHOD OF HEAT-TREATING DUCTILE CAST IRON PIPE

This is a continuation, of application Ser. No. 678,899, filed Apr. 21, 1976 now abandoned.

BACKGROUND OF THE INVENTION

The present invention generally relates to the art of manufacture of ductile cast iron pipes by means of a centrifugal casting and, more particularly, to a method of annealing a casting of ductile cast iron or spheroidal graphite cast iron within a centrifugal casting mold.

DESCRIPTION OF THE PRIOR ART

It is well known that pipes made of ductile cast iron or spheroidal graphite cast iron by means of a centrifugal casting technique are, subsequent to centrifugal casting, subjected to an annealing process to relieve internal stresses previously set up in the pipes and also to improve a physical strength thereof. According to the conventional method of manufacture of ductile cast iron pipes by the use of the centrifugal casting technique, however, in order for the ductile cast iron pipes to be annealed, the pipes are successively transported across a horizontal annealing furnace after the pipes as cast have been drawn, or otherwise removed, out of associated centrifugal casting molds.

In view of the fact that the conventional method requires the drawing or removal of the casting out of the corresponding centrifugal casting mold to be performed prior to the annealing process, various disadvantages have been found. For example, during the drawing of the casting out of the centrifugal casting mold, the casting tends to cool and, in particular, the temperature thereof rapidly decreases immediately after it has been drawn or removed out of the centrifugal casting mold. The consequence is that the time required for the casting to be subsequently annealed is prolonged with the increased amount of fuel to be combusted by gas burners within the annealing furnace. Moreover, where the manufacture of ductile cast iron pipes having a bore of about 500 mm. or more is involved, a relatively large space for temporary storage of the centrifugal casting molds, which have been rendered empty by drawing or removing the castings therefrom in readiness for the subsequent use, is required in the vicinity of the centrifugal casting site.

SUMMARY OF THE INVENTION

Accordingly, an essential object of the present invention is to provide an improved method of manufacturing a ductile cast iron pipe wherein annealing of the ductile cast iron pipe as cast by the centrifugal casting technique is carried out while said ductile cast iron pipe as cast is accommodated within the centrifugal casting mold, thereby substantially eliminating the disadvantages and inconveniences inherent in the prior art method of a similar kind.

DESCRIPTION OF THE PREFERRED EMBODIMENTS

Specifically, the method according to the present invention is carried out by first pouring a molten ductile cast iron into a horizontally laying, hollow cylindrical mold being rotated at a high speed about the longitudinal axis thereof so that, by the effect of centrifugal force, the metal is held against the interior wall of the mold to form within the mold a casting correponding to the ultimate ductile cast iron pipe. The casting within the centrifugal casting mold is subsequently transported along a guide rail assembly towards an annealing site where dissipation of heat energies evolved in the casting within the centrifugal casting mold is slowed down to allow the casting to cool at a controlled slow rate. The slow-down of dissipation of the heat energies evolved in the casting can readily be achieved by closing both ends of the centrifugal casting mold and/or by supplying a blast of hot gas of elevated temperature through the casting within the centrifugal casting mold while both ends of the mold is closed.

In one illustrated embodiment of the present invention, the annealing site is divided into three zones; higher temperature zone, intermediate temperature zone and lower temperature zone arranged in series and in the order given above. These different temperature zone can be created by conducting the hot gas, which has passed through the casting within the mold at one position, towards the casting within the mold at another position next to said one position and finally towards the casting within the mold at a further position followed by said another position, said one position, another position and further position corresponding respectively to said higher, intermediate and lower temperature zones.

As a source of the hot gas, one or more fuel burners may be employed. Alternatively, any exhaust gas of sufficiently elevated temperature may be employed such as exhausted from a cupola or melting furnace or from a heat-exchanger.

After the annealing process, the casting within the centrifugal casting mold is drawn, or otherwise removed, out of the mold to provide a ductile cast iron pipe ready to be placed on a commercial market with or without requiring a subsequent machining process.

From the foregoing, it is clear that, since annealing is carried out while the casting to be annealed remains within the centrifugal casting mold, no space for temporary storage of the molds is substantially required in contrast to the practice of the prior art method of the similar kind. Moreover, the amount of fuel required to be supplied to the burners can advantageously be minimized to avoid any possible waste thereof. The amount of the fuel can further be minimized or no fuel would be required, if the exhaust gas of sufficiently elevated temperature, such as emitted from the cupola necessary to prepare molten ductile cast iron for the pipe or from the heat exchanger, is employed for heating and casting within the mold so that dissipation of the heat energies evolved in the casting can be slowed down.

DESCRIPTION OF THE DRAWINGS

These and other objects and features of the present invention can readily be understood from the following description taken in connection with a preferred embodiment thereof with reference to the accompanying drawings, in which.

Before the description of the present invention proceeds, it is to be noted that like parts are designated by like reference numerals throughout the accompanying drawings.

Figure 1:
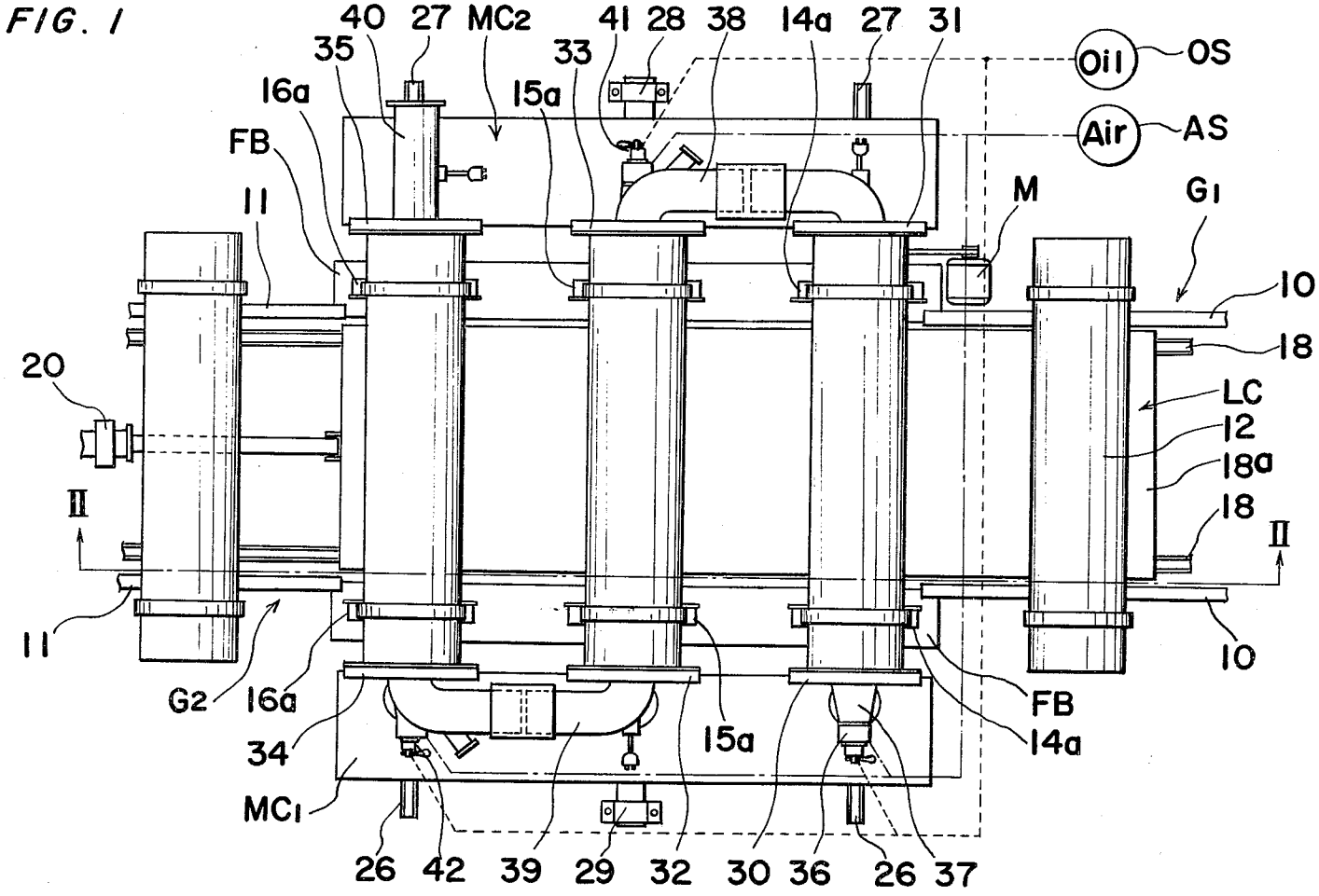
FIG. 1 is a schematic top plan view of an apparatus for heat-treatment of castings while the latter are held within corresponding centrifugal casting molds, said heat-treating apparatus being located at an annealing site with three castings within the molds shown as being heat-treated.
Figure 2:
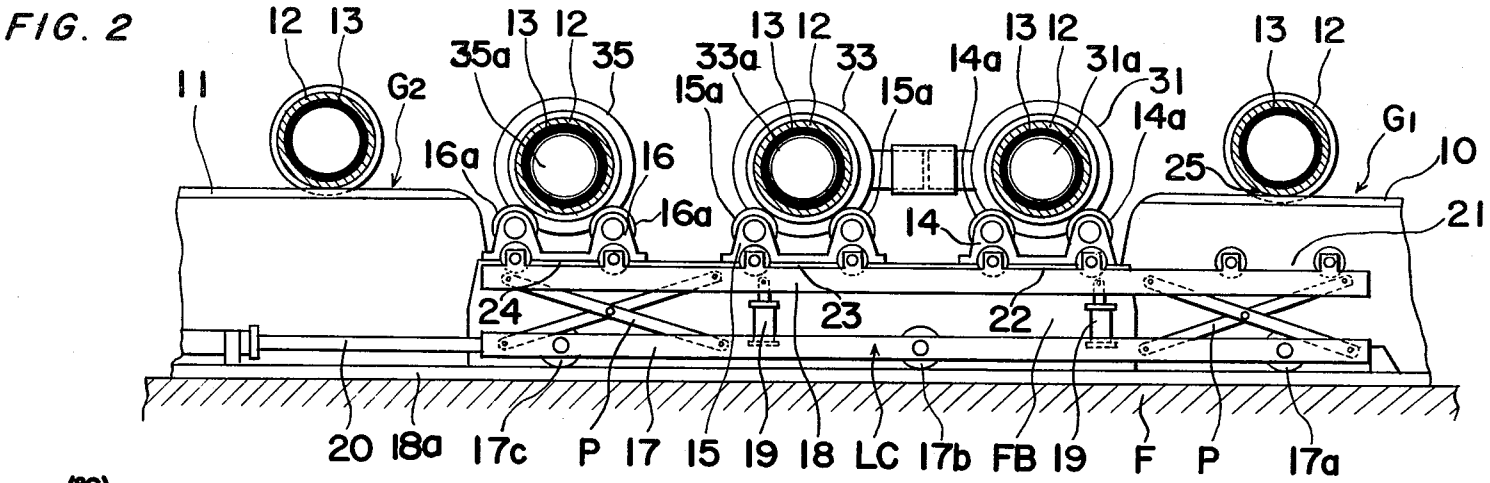
FIG. 2 is a cross sectional view taken along the line II—II in FIG. 1.

Referring to the drawings and, particularly, to FIGS. 1 and 2, there is illustrated a heat-treating apparatus installed on a suitable foundation F, such as a ground floor in a casting plant, and at an annealing site intermediately between a centrifugal casting site and a drawing site. The annealing site where the apparatus is installed is connected by means of spaced guide structures G1 and G2, each on one side of the apparatus, to the centrifugal casting site on one hand and to the drawing site on the other hand. So far illustrated, each of the guide structures G1 and G2 is composed of a pair of spaced rails 10 or 11 supported above the foundation F in any known manner. The guide rails 10 of the pair are adapted to support thereon centrifugal casting molds, only one of which is shown by 12, which casting molds are successively transported from the centrifugal casting site (not shown) at a predetermined interval of time while they roll along said guide rails 10. It is to be noted that each of the centrifugal casting molds 12 has a casting of ductile cast iron, in the form of a pipe 13 as cast and in red-hot state, held against the interior wall of the centrifugal casting mold 12. Formation of the ductile cast iron pipe 13 within the centrifugal casting mold 12 is achieved at the centrifugal casting site by any known centrifugal casting method and, therefore, the details thereof are herein omitted for the sake of brevity.

The apparatus shown includes a pair of fixed support benches FB extending between the guide structures G1 and G2 and spaced from each other a distance substantially equal to or greater than the inside span between the rails of any of the guide structures G1 and G2, but smaller than the greatest possible length of the centrifugal casting mold with which the apparatus is operated. Rigidly mounted on each of the fixed support benches FB are bearing stands 14, 15 and 16 which are equidistantly spaced from each other, each of which bearing stands 14 to 16 carries a pair of spaced rollers generally indicated by 14*a*, 15*a* or 16*a*. It is to be noted that the bearing stands 14 to 16 on one of the opposed fixed support benches FB and the bearing stands 14 to 16 on the other of the opposed fixed support benches FB are respectively aligned with each other. At least one of each pair of the rollers 14*a*, 15*a* and 16*a* supported by the respective bearing stands 14, 15 and 16 on either one of the fixed support benches FB is operatively coupled by means of any suitable transmission system to a drive mechanism which is shown in the form of an electrically powered motor M.

Although in FIGS. 1 and 2 three molds 12 with respective castings in red-hot state therein are shown as having already been supported rotatably by the bearing stands 14, 15 and 16, these are mounted in such a manner as will subsequently be described.

Positioned within a space defined between the fixed support benches FB is a lifting carriage generally indicated by LC. The lifting carriage LC comprises a wheeled undercarriage 17 having, for example, three pairs of wheels 17*a*, 17*b* and 17*c* through which said undercarriage 17 is mounted on a pair of spaced rails 18*a* on the foundation F for movement between take-in and take-out positions as will be described later. The lifting carriage LC further comprises a delivery deck 18 mounted on the undercarriage 17 by means of pantograph mechanisms P of any known construction so that the delivery deck 18 can selectively be elevated and lowered by fluid operated cylinders 19. For effecting the movement of the undercarriage 17 between the take-in and take-out positions, a fluid operated cylinder 20 having a casing, rigidly mounted on the foundation F, and a plunger coupled to the undercarriage 17 is employed.

It is to be understood that the various cylinders 19 and 20 are operatively associated with each other so as to operate the lifting carriage in the following sequence:

(a) Assuming that the undercarriage 17 has arrived at the take-in position, as shown, from the take-out position, the delivery deck 18 is elevated for the purpose as will be described later after a predetermined time subsequent to the arrival of the undercarriage 17 at said take-in position;

(b) The undercarriage 17 is, immediately after the delivery deck 18 has completely been elevated, moved from said take-in position towards the take-out position while said delivery deck 18 is held in elevated position;

(c) Immediately after the undercarriage 17 with the delivery deck 18 in the elevated position has arrived at the take-out position, the delivery deck is lowered; and (d) Simultaneously with or immediately after the complete lowering of the delivery deck 18, the undercarriage 17 is moved from the take-out position towards the take-in position with said delivery deck 18 held in lowered position as shown.

In this way, one cycle of operation of the lifting carriage LC completes.

The delivery deck 18 has four stations 21, 22, 23 and 24 each being defined by two sets of spaced pairs of rollers rotatably mounted thereon. These four stations 21 to 24 are equally spaced from each other a distance equal to the pitch between every adjacent two of the bearing stands 14, 15 and 16 on the fixed support benches FB and are so positioned that, when the undercarriage 17 is in the take-in position as shown, the stations 22, 23 and 24 can be aligned with the bearing stands 14, 15 and 16, respectively, and when the undercarriage is in the take-out position, the stations 21, 22 and 23 can be aligned with said bearing stands 14, 15 and 16, respectively.

The lifting carriage LC is designed such that the plane of the delivery deck 18 when in the elevated position lies above the plane of any one of the guide rails 10 and 11. Therefore, the front one of the centrifugal casting molds with the corresponding castings therein, which is engaged to stoppers 25 so formed on the guide rails 10 of the guide structure G1 that the front mold can be supported at the station 21 when the delivery deck 18 is in the elevated position with said undercarriage 17 held in the take-in position, can be lifted above the stoppers 25 sufficient to allow the front mold to be transported over said stoppers 25 onto a position immediately above the bearing stand 14 as the undercarriage 17 with the delivery deck 18 in the elevated position is subsequently moved. If the bearing stands 14, 15 and 16 are occupied by the centrifugal casting molds at the time said front mold is brought to the position immediately above the bearing stand 14 in the manner as hereinbefore described, the mold on the bearing stand 14, the mold on the bearing stand 15 and the mold on the bearing stand 16 are respectively brought to the next positions immediately above the bearing stand 15, the bearing stand 16 and the guide rails 11 of the guide structure G2, clearing the bearing stand 14 in readiness for the support of the front mold transferred from the guide rails 10.

From the foregoing, it is clear that each complete operation of the lifting carriage LC results in successive transportation of the centrifugal casting mold from the guide structure G1 onto the guide structure G2 past the annealing site. It is to be noted that, so long as heat-treatment is subjected to the castings 13 within the molds 12, supported on the bearing stands 14, 15 and 16, in a manner as will be described later, these molds on the bearing stands 14 to 16 are rotated about their own longitudinal axes in contact with the rollers 14*a*, 15*a* and 16*a* which are coupled to the motor M as hereinbefore described, thereby avoiding the possibility that the castings 13, which are still in the red-hot state within the corresponding casting molds 12, would be deformed under the influence of the gravity force, which possibility may otherwise occur if the casting molds on the bearing stands 14, 15 and 16 would not be rotated.

The molds having therein the castings which have been heat-treated and, therefore, transported onto the guide rails 11 in the manner as hereinbefore described are allowed to roll along the guide rails 11 towards the drawing site where said castings are drawn, or otherwise removed, out of the corresponding molds to provide ductile cast iron pipes.

So far illustrated, annealing heat-treatment is carried out in three stages and, for this purpose, there are higher temperature zone, intermediate temperature zone and lower temperature zone which are respectively defined by the pairs of the bearing stands 14, 15 and 16.

The apparatus further comprises movable carriages MC1 and MC2 mounted on respective pairs of spaced rails 26 and 27 for movement between operative and inoperative positions. These carriages MC1 and MC2 are so moved by fluid operated cylinders 28 and 29 synchronized with each other. These cylinders 28 and 29 are in turn operatively associated with the cylinders 19 and 20 so that the carriage MC1 and MC2 are simultaneously moved to the operative position, as shown, in a direction towards each other and towards the adjacent support benches FB when the delivery deck 18 on the undercarriage 17 moved to the take-out position is held in the lowered position and are simultaneously moved towards the inoperative position in a direction away from each other and from the adjacent support benches FB simultaneously with or shortly before the movement of the delivery deck 18 from the lowered position towards the elevated position while the undercarriage 17 is held in the take-in position.

Three refractory closure discs 30, 32 and 34, each having a central opening defined therein, are rotatably mounted on the movable carriage MC1 with said openings in said discs 30, 32 and 34 held in position to align with the respective longitudinal axes of the molds on the bearing stands 14, 15 and 16.

Similarly, three refractory closure discs 31, 33 and 35, each having a central opening 31*a*, 33*a* and 35*a* defined therein as shown in FIG. 2, are rotatably mounted on the movable carriage MC2 with said openings 31*a*, 33*a* and 35*a* held in position to align with the respective longitudinal axes of the mold on the bearing stands 14, 15 and 16.

The refractory closure discs 30, 32, 34 and 31 33, 35 are cooperative in pairs so that, when the movable carriage MC1 and MC2 are moved to the operative position, the refractory closure discs 30 and 31, 32 and 33, and 34 and 35 close respective ends of the molds supported on the bearing stands 14, 15 and 16 as best shown in FIG. 1. It is to be noted that each of the closure discs 30 to 35 is rotatable in contact with the corresponding end of the molds being rotated by the motor M in the manner as hereinbefore described.

The refractory closure disc 30 carries a fuel burner 36 communicated with the opening in said refractory closure disc 30 through a duct 37 through which a blast of hot air, generated by the combustion of air and fuel respectively fed from sources of air and fuel OA and OS, is introduced into the hollow of the casting held within the mold on the bearing stand 14, that is, at the higher temperature zone.

For introducing the hot gas, which flows through the hollow of the casting within the mold at the higher temperature zone, into the hollow of the casting within the mold on the next adjacent bearing stand 15, that is, at the intermediate temperture zone, the opening 31*a* in the refractory closure disc 31 is communicated to the opening 33*a* in the refractory closure disc 33 by means of a telescopically extensible duct 38. Similarly, for introducing the hot gas, which flows through the hollow of the casting within the mold at the intermediate temperature zone, into the hollow of the casting within the mold on the bearing stand 16, that is, at the lower temperature zone, the opening in the refractory closure disc 32 is communicated to the opening in the refractory closure disc 34 by means of a telescopically extensible duct 39. The hot gas flowing through the hollow of the casting within the mold at the lower temperature zone is then exhausted to the atmosphere through the opening 35*a* in the refractory closure disc 35 by way of an exhaust duct 40.

Any one of the telescopically extensible ducts 38 and 39 may be of a construction having two duct lengths connected to each other by a refractory sleeve into which adjacent ends of said duct lengths are axially adjustably inserted. The employment of the telescopically extensible ducts 38 and 39 is so advantageous as to allow the apparatus to accommodate different bore sizes of molds with the castings therein.

In the practice of the heat-treatment according to the present invention, the hot gas produced by the fuel burner 36 is first supplied through the hollow of the casting within the mold at the high temperature zone, then introduced into the hollow of the casting within the mold at the intermediate temperature zone via the duct 38 and finally into the hollow of the casting within the mold at the lower temperature zone via the duct 39 before it is exhausted to the atmosphere through the duct 40, with the temperature of the hot gas gradually decreasing as it travels an increasing distance from the burner 36. Because the temperature drop occurs in the hot gas as the latter travels an increasing distance from the burner 36 as hereinbefore described, any one of the castings within the molds can slowly be cooled as it is transferred from the higher temperature zone to the intermediate temperature zone and then from the intermediate temperature zone to the lower temperature zone. So far as the manufacture of ductile cast iron pipes is involved, it is preferred to maintain the temperature, at which annealing is carried out, within the range of 800° to 850° C. at the higher temperature zone and not more than 650° to 550° C. at the lower temperature zone, the temperature at the intermediate temperature zone being substantially in the middle of these high and low ranges.

It is to be noted that, while in the foregoing description the anealing has been described as being carried out in three stages, it can be carried out in a single stage. In such case, a burner for applying a hot gas into the hollow of the casting within the centrifugal casting mold may be operated so that the dissipation of heat energies evolved in the casting in red-hot state can be delayed to allow the casting to cool at a controlled slow rate. For annealing in the single stage, the apparatus shown may be employed.

Referring to FIGS. 1 and 2, auxiliary burners 41 and 42 both coupled to the air and fuel sources AS and OS may, if desired, be employed to additionally heat respective hot gases to be supplied through the hollows of the castings at the intermediate and lower temperature zone, thereby avoiding an excessive temperature difference between the higher temperature zone and any one of the intermediate and lower temperature zones. In other words, if the temperature of the hot gas to be supplied through the casting within the mold at the intermediate temperature zone becomes lower than a predetermined temperature, the auxiliary burner 41 is ignited while, if the temperature of the hot gas to be subsequently supplied through the casting within the mold at the lower temperature zone becomes lower than a predetermined temperature, the auxiliary burner 42 is ignited.

The apparatus so far illustrated operates in the following manner. Assuming that no centrifugal casting mold with a casting therein has been transported to the annealing site and, therefore, the higher, intermediate and lower temperature zones have not yet been occupied thereby and that the undercarriage 17 is held in the take-in position with the delivery deck 18 in the lowered position, the delivery deck 18 is first elevated to allow the first one of the centrifugal casting molds, each with a casting therein, staying on the rails 10 of the guide structure G1 as transported from the centrifugal casting site, to be upwardly lifted while it is supported by the station 21 on the delivery deck 18. Subsequent movement of the undercarriage 17 from the take-in position towards the take-out position causes the first mold with the casting therein to be brought to a position immediately above the bearing stands 22 on the fixed support benches FB, which first mold with the casting therein becomes rotatably mounted on said bearing stands 22 when the delivery deck 18 is then lowered while said undercarriage 17 still held in the take-out position.

Simultaneously with the complete lowering of the delivery deck 18 with the undercarriage 17 in the take-out position, the movable carriages MC1 and MC2 are moved towards the operative position. The undercarriage 17 in the take-out position may be returned to the take-in position during or after the movement of the movable carriages MC1 and MC2 to the operative position.

It is to be noted that, at the outset of operation, two empty casting molds, having no casting therein, or similar tubings are preferably installed on the bearing stands 23 and 24 prior to installation of the casting mold, having the casting therein, on the bearing stands 22, or subsequent thereto, but prior to the movement of the movable carriage MC1 and MC2 towards the operative position. This installation of the empty molds or similar tubings can readily be carried out either by the aid of a gantry crane or by transporting them from the rails 10 by the aid of the lifting carriage LC. These empty molds or similar tubings, if installed in the manner as hereinbefore described, serve as guide ducts for guiding the hot gas, which has flowed into the duct 38 through the casting within the mold on the bearing stands 22, that is, at the higher temperature zone towards the exhaust duct 40 via the duct 39.

Upon completion of movement of the movable carriages MC1 and MC2 to the operative position as shown, both ends of the casting mold, with the casting therein, which is supported on the bearing stands 22, are closed by the refractory closure discs 30 and 31 while those of the empty molds or similar tubings are closed respectively by the refractory closure discs 32 and 33, 34 and 35 to complete a substantially closed circuit for flow of the hot gas from the duct 38 to the exhaust duct 40.

The fuel burner 36 may be ignited either after the movable carriages MC1 and MC2 have been moved to the operative position or before they are moved to the operative position. In practice, the fuel burner 36 is continuously operated so as to generate the hot gas of sufficiently elevated temperature so long as production of ductile cast iron pipes continue, that is, during a daily working hour of the pipe manufacturing plant.

In this way, the casting within the first mold on the bearing stands 22, that is, at the higher temperature zone, is heated by the hot gas supplied from the burner 36 into the hollow of said casting within the first mold. During the heating and, more particularly, immediately after completion of the movement of the carriages MC1 and MC2 to the operative position, the motor M is energized to rotate the first mold on the bearing stands 22 and also the empty molds or similar tubings about their own longitudinal axes as hereinbefore described. At this time, the closure discs 31 to 35 are also rotated in contact with the corresponding ends of the first mold and empty molds or similar tubings.

It is to be noted that, since the casting within the first mold on the bearing stands 22 is still in red-hot state, the temperature thereof is presumably higher than the temperature of the hot gas flowing through the casting within the first mold from the fuel burner 36. This temperature difference is, however, considerably smaller than that whch may be created if no heating would be effected, and therefore allows dissipitation of the heat energies evolved in the red-hot casting at the higher temperature zone to be delayed or slowed down.

After the primary heat-treatment in the manner as hereinbefore described has been continued for a predetermined time, the movable carriages MC1 and MC2 are moved towards the inoperative position with the closure discs 30 to 35 separating from the associated ends of the first mold and the empty molds or similar tubings. Simultaneously with or after the movement of the carriages MC1 and MC2 from the operative position towards the inoperative position, the delivery deck 18 is again elevated, while the undercarriage 17 is in the take-in position, thereby commencing the next cycle of operation of the lifting carriage LC.

The next cycle of operation of the lifting carriage LC results in that the empty molds or similar tubings and the first mold are transported in a direction towards the guide structure G2; one empty mold or similar tubing being transferred onto the rails 11, the other empty mold or similar tubing onto the bearing stands 24 and the first mold onto the bearing stands 23, while the next adjacent mold with a red-hot casting therein, which has been on the rails 10, is transferred onto the bearing stands 22 which has previously been occupied by the first mold.

While the casting within the second mold so transferred from the guide structure G1 onto the bearing stands 22 receive the substantially same heat-treatment as subjected to the casting within the first mold now at the intermediate temperature zone, the casting within the first mold is heated by the hot gas which is generated by the burner 36, but has passed through the casting within the second mold. Since the temperature of the hot gas at the time of flow through the casting at the intermediate temperature zone is lower than that at the time of flow through the casting at the higher temperature zone, the dissipation of the heat energies evolved in the casting at the intermediate temperature zone is again so controlled that the temperature of the casting at the intermediate temperature zone approximates to the temperature of the hot gas flowing through such casting at a slow cooling rate. This has occurred even at the higher temperature zone.

The casting within the first mold and that within the second mold are subsequently transferred onto the lower temperature zone and the intermediate temperature zone, respectively, while the remaining empty mold or similar tubing, which has occupied the bearing stands 24, is transferred onto the guide structure G2 on one hand and the third one of the molds staying on the rails 10 is transferred onto the higher temperature zone. It is to be noted that the casting within the first mold at the lower temperature zone is also heated by the hot gas, the temperature of which gas is, however, lower than that of the hot gas flowing through the casting within the second mold at the intermediate temperature zone which is in turn lower than that flowing through the casting within the third mold at the higher temperature zone.

From the foregoing, it will readily be seen that, by every three cycles of operation of the apparatus, any one of the molds, each with a casting therein, which have been transported from the centrifugal casting site onto the guide structure G1, can be transferred from the higher temperature zone to the lower temperature zone through the intermediate temperature zone, the condition in which the first to third molds are respectively positioned at the lower, intermediate and higher temperature zones being illustrated in FIGS. 1 and 2.

If the temperature within one or both of the castings at the intermediate and lower temperature zones is excessively low to such an extent that the expected slow cooling of the casting can no longer be achieved, one or both of the auxiliary burners 41 and 42 may be ignited.

The number of temperature zones at which each casting within the mold is successively heat-treated may not be limited to three such as shown, but may be more or less than three. Theoretically, the greater the number of the temperature zones, the more slowly can the casting be cooled to a room or ambient temperature. However, since the increased number of the temperature zones requires the prolonged annealing time with consequent reduction of the production capacity, according to the method of the present invention heat-treatment effected for the purpose of slowing down the rate of dissipitation of the heat energies, evolved in the red-hot casting within the mold, thereby to allow such casting to be annealed under a predetermined temperature gradient is preferably ceased when the temperature of the casting at the lower temperature zone attains a predetermined value equal to or less than the range of 650° to 550° C., such casting being thereafter allowed to stand cooling to a room or ambient temperature.

Referring still to FIGS. 1 and 2, any one of the castings within the molds which have been transferred onto the guide rails 11 of the guide structure G1 is transported to the drawing site where it is drawn, or otherwise removed, out of the corresponding mold in any known manner. The casting when to be drawn or removed out of the mold may not completely be cooled to the room or ambient temperature.

The present invention will now be described by way of example for the illustrative purpose.

A casting, which ultimately became a spheroidal graphite cast iron pipe having a bore diameter of 600 mm., a length of 6,000 mm. and a wall thickness of 15 mm. and which had been formed against the wall of a centrifugal casting mold by the known centrifugal casting method, was annealed by the illustrated apparatus in three stages. The composition of the heat-treated casting is tabulated below.

| COMPOSITION (%) | | | | | |
|---|---|---|---|---|---|
| C | Si | Mn | P | S | Mg |
| 3.4 | 2.6 | 0.4 | 0.05 | 0.01 | 0.04 |

Figure 3:
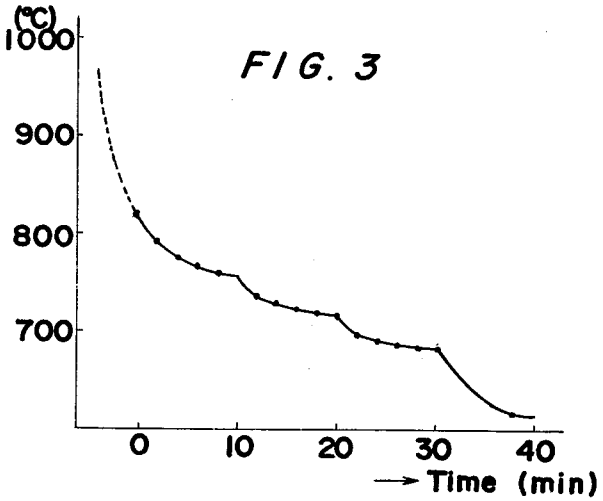
FIG. 3 is a graph illustrating variation in temperature of a casting within a centrifugal casting mold with respect to the time elapsed.

The temperature at which the casting was heat-treated during the annealing was measured each time about 2 minutes had passed and is plotted in the graph of FIG. 3. In the graph of FIG. 3, the time spans, indicated by B, C and D, respectively, represent individual periods during which the casting was heat-treated at the higher, intermediate and lower temperature zones, while a curve shown by the broken line represents a temperature drop which occurred prior to the commencement of the heat-treatment at the annealing site.

It is to be noted that, since the method of the present invention is designed such as to achieve the heat-treatment with a minimized amount of fuel consumed, an extremely slow-cooling of the casting would be difficult to achieve. Therefore, to facilitate to a certain extent change of the constituents of the casting into ferrite, it is advisable to employ silicon in an amount within the range of 2.0 to 3.0%. If the amount of silicon to be employed is in excess of the uppermost limit, the resultant ductile cast iron pipe would become fragile as compared with that containing silicon in an amount within the above described range. In order to avoid the fragile casting, that is, the ductile cast iron pipe, the silicon in an amount within the above described range is employed to allow formation of a ferrite base structure in the casting.

The structure of the ductile cast iron pipe thus manufactured was found as composed of 85% ferrite, 15% pearlite and 0% cementite with 90% spherodized.

In the practice of the method of the present invention, since the casting in the form as held against the wall of the centrifugal casting mold is slowly cooled from the $Ar_1$ transformation point by the effect of controlled dissipitation of the heat energies, with or without the aid of the hot gas generated by the burner, the austenite can be transformed into ferrite and graphite. The cementite which tends to be formed during casting cannot be decomposed according to the method of the present invention and, therefore, no cementite should be present from the beginning of casting. However, if the burner 36 capable of producing the hot gas of a temperature sufficient to heat the casting to about 950° C. is employed, the cementite can be decomposed. This technique is not recommendable in view of the fact that the mold having the casting therein tends to be heated to about 600° C. or more which will results in possible deformation of the mold and, consequently, deformation of the resultant ductile cast iron pipe.

From the foregoing description, it is clear that the annealing according to the present invention is carried out by transporting a centrifugal casting mold, having therein a red-hot casting as cast, to the annealing site where a hot gas is allowed to flow through the red-hot casting thereby controlling the dissipation of heat energies from the casting to cause the latter to be slowly cooled.

As compared with the prior art method wherein the annealing is carried out after the casting has been cooled and subsequently drawn or removed out of the centrifugal casting mold, the method of the present invention is advantageous in that the amount of fuel necessitated to heat-treat the casting and the length of time required to manufacture a ductile cast iron pipe can be reduced since it is not required for the casting, once cooled, to re-heat to the elevated temperature at which annealing takes place. More economical with respect to the amount of fuel to be used and the length of time required to make the ductile cast iron pipe is where, as described with reference to the accompanying drawings, the hot gas is allowed to flow through a plurality of castings within the centrifugal casting molds arranged side-by-side relation to each other, but in series-connected relation with respect to the direction of flow of the hot gas, while the molds with the castings therein are intermittently transferred from the higher temperature zone to the lower temperature zone through one or more intermediate temperature zones.

Furthermore, according to the present invention, since annealing is carried out subject to castings while the latter are still held within the molds, no space for temporary storage of the empty molds is required between the casting site and the annealing site. Moreover, the method of the present invention makes it possible to manufacture ductile cast iron pipes continuously.

Although the present invention has fully been described in connection with the preferred embodiment thereof with reference to the accompanying drawings, it is to be noted that various changes and modifications can readily be conceived by those skilled in the art from the foregoing description and/or the accompanying drawings. By way of example, without utilizing the apparatus shown in FIGS. 1 and 2, annealing may be carried out at the centrifugal casting site. In such case, while a centrifugal casting mold having therein a casting as cast is rotatably mounted on a centrifugal casting machine of any known construction, a hot gas is introduced into the hollow of the casting while both ends of the mold are substantially closed by closure discs similar in construction to the illustrated pair of the refractory closure discs 30 and 31, 32 and 33 or 34 and 35.

Where the annealing is carried out in a single stage merely by introducing the hot gas into the hollow of the casting within the mold and then exhausting it to the outside, it is not always necessary to adjust the temperature of the hot gas by controlling the operation of the burner 36, but it may be possible to introduce the hot gas of such a temperature as attained by the casting when the annealing of the latter is ceased.

Moreover, where a casting in the form of a pipe is prepared from molten pig iron refined so as to have a relatively high capability of graphitization, it may be cooled at a relatively high cooling rate of 10° C. or more per minute without accompanying formation of pearlite. This high cooling rate of 10° C. or more per minute can readily be achieved only by closing both ends of the centrifugal casting mold with the casting therein. This is possible because, when the ends of the centrifugal casting mold are closed while it contains therein the casting in the red-hot state, no air of a room or ambient temperature is allowed to flow through the casting within the mold, with consequent reduction of a loss of heat which may otherwise results from convection, while the cooling rate is solely controlled by radiant heat energies evolved from the red-hot casting. In view of this, direct transformation of austenite into ferrite and graphite can substantially be achieved merely by closing the ends of the mold, having the casting therein, with the use of closures.

Furthermore, the interior wall surface of the casting within the casting mold may be coated with a heat insulating material such as a powder of diatomaceous earth to keep the casting in thermally insulated condition during the cooling thereof. In addition, although the source of the hot gas has been described as constituted by the burner for combusting a mixture of air and fuel, it may be constituted by an exhaust gas of sufficiently elevated temperature of a type emitted from a cupola or a heat-exchanger.

Accordingly, such changes and modifications are to be understood as included within the true scope of the present invention unless they depart from such scope of the present invention.

What is claimed is:

1. A method of manufacturing a plurality of ductile cast iron pipes which comprises the steps of:

continuously centrifugally casting molten metal to form, within centrifugal casting molds, castings which ultimately form the ductile cast iron pipes;

transporting the molds with the castings therein, one at a time, while the castings are still in a red-hot state, to an annealing site; annealing the castings within the molds at a plurality of successively different heating zones including at least a first zone and a last zone by passing a hot gas of varying temperature through the castings within the mold such that the first zone has the highest temperature and the last zone the lowest temperature;

successively transferring said molds from the first zone to the last zone in such a manner so as to slow down the dissipation of heat energies from the red-hot castings by the gradual reduction of the temperature in the heating zones, said variation in the temperature of the heating zones being effected by flowing the hot gas first through the hollow portion of the mold containing the casting in the red-hot state at the first zone and then successively into each of the hollow portions of said molds of lower temperature by means of telescopically extensible ducts connecting one mold with another so that the hot gas is gradually cooled as it passes from the mold in the first zone successively to the last zone, automatically clamping said telescopically extensible ducts onto the openings of the molds as the molds move into each heating zone so that all of the molds are connected in a row to form a closed system to permit the gas to pass there-through; automatically removing said ducts from the molds when being transferred to the next successive zone;

synchronizing said automatic clamping and removal of the telescopically extensible ducts with the movement of the molds from one heating zone to a heating zone of lower temperature so that clamping of the telescopically extensible ducts occurs when the molds are located at the heating zones and removed when the molds are transferred to the next heating zone, and;

removing the castings so heat-treated from the mold in a continuous manner, thereby providing a plurality of ductile cast iron pipes.

2. A method according to claim 1, including the step of mechanically rotating the molds within each of the heating zones of varying temperature during the annealing.

3. A method according to claim 1, including the step of generating hot gas by a fuel burner carried by one of a pair of opposed ducts adapted to close the opposed ends of the centrifugal casting mold at the time said casting mold is positioned at the first temperature zone.

4. A method according to claim 1, wherein said hot gas is an industrial waste gas of sufficiently elevated temperature.

5. A method according to claim 1, including the step of applying a thermal insulating material to the inner wall surface of the casting within the mold prior to annealing.

6. A method according to claim 3, including the step of providing each of the at each zone adapted to be fuel burners to a mold at that zone connected, to impart additional hot gases to the different molds when the temperature differences between successive heating zones exceeds a predetermined value.

7. A method according to claim 1, wherein the annealing heating zones are divided into three zones, the first having a temperature of 800°-850° C., the last having a temperature of between 550°-650° C. and wherein the intermediate heating zone has a temperature range substantially between the upper and lower ranges.

8. An apparatus for annealing a plurality of ductile cast iron pipes which have been cast in a centrifugal casting mold while the casting therein is in a red-hot state, which comprises a pair of guide structures containing guide rails thereupon made up of a first guide structure for receiving centrifugal casting molds containing castings in a red-hot state from a centrifugal casting site and a second guide structure for taking out the centrifugal casting molds after the castings have been annealed, a plurality of fixed bearing stands defining an annealing zone and located between the first and second guide structures, said bearing stands being equidistantly spaced from each other, each bearing stand designed to hold one centrifugal casting mold, said bearing stands carrying a pair of spaced rollers thereupon for rotating the molds containing the castings therein, means for rotating at least one of the said pair of rollers located on said fixed bearing stands, at least one movable station located underneath the fixed bearing stands for transporting the centrifugal casting molds, said movable station being capable of being raised or lowered to elevate or lower the molds located on the fixed bearing stands, said movable station moving between a waiting position and take-in or take-out positions in order to carry the centrifugally cast mold from the first guide structure successively through each of the fixed bearing stands and finally to the second guide structure, said movable station being operated by a pair of associated hydraulic cylinders which operate in tandem for moving said centrifugal mold from the take-in to the take-out position, a pair of carriages provided at both sides of said guide structures to move toward or apart from the fixed bearing stands and having a plurality of ducts located thereupon, means to synchronously move said carriages toward or apart from the fixed bearing stands, means associated with the ducts for detachably connecting the ducts with said molds in such a manner that when the movable station is in the take-in or take-out position, the carriages with the ducts are apart from the fixed bearing stands, and, when the movable station is in the waiting position, the carriages are moved toward the fixed bearing stands to connect the ducts with the molds supported on the fixed bearing stands so that all of the molds are connected in a row with each other via the ducts therebetween, a first one of the ducts next to said first guide structures being connected with a source for introducing the flow of hot gas, said mold and duct assembly forming a closed system whereby hot gas may be passed from said duct through the first mold to each successive mold, thereby defining a series of successively decreasing temperature zones due to the gradual cooling of the hot gas as it passes from the first to the last mold, whereby the castings within the molds are annealed.

9. An apparatus according to claim 8, wherein the number of movable stations corresponds to the combined number of fixed bearing stands plus one of the guide structures, said movable stations equidistantly spaced from each other at a distance substantially corresponding to the distance between the fixed bearing stands so that they can be aligned with the bearing stands to transfer the molds from one temperature zone to another, said movable stations containing two sets of spaced rollers rotatably mounted thereupon, said movable stations being located upon a delivery deck, said delivery deck being mounted on a wheeled undercarriage by means of a pantograph mechanism by which the delivery deck can be selectively elevated and lowered by means of a fluid operated cylinder, said undercarriage being mounted on a pair of spaced rails and being moved on said rails from the take-in to the take-out position by means of a fluid operated cylinder.

* * * * *